US010932078B2

(12) United States Patent
McGrath et al.

(10) Patent No.: US 10,932,078 B2
(45) Date of Patent: Feb. 23, 2021

(54) SYSTEM AND METHOD FOR SPATIAL PROCESSING OF SOUNDFIELD SIGNALS

(71) Applicant: DOLBY LABORATORIES LICENSING CORPORATION, San Francisco, CA (US)

(72) Inventors: David S. McGrath, Rose Bay (AU); Rhonda Wilson, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 337 days.

(21) Appl. No.: 15/746,787

(22) PCT Filed: Jul. 27, 2016

(86) PCT No.: PCT/US2016/044286

§ 371 (c)(1),
(2) Date: Jan. 22, 2018

(87) PCT Pub. No.: WO2017/019781

PCT Pub. Date: Feb. 2, 2017

(65) Prior Publication Data

US 2020/0120437 A1 Apr. 16, 2020

Related U.S. Application Data

(60) Provisional application No. 62/198,440, filed on Jul. 29, 2015.

(30) Foreign Application Priority Data

Sep. 18, 2015 (EP) ..... 15185913

(51) Int. Cl.

| | |
|---|---|
| ***H04S 7/00*** | (2006.01) |
| ***G10K 15/12*** | (2006.01) |
| ***H04S 3/02*** | (2006.01) |

(52) U.S. Cl.

CPC ..... *H04S 7/302* (2013.01); *G10K 15/12* (2013.01); *H04S 3/02* (2013.01); *H04S 2400/01* (2013.01);

(Continued)

(58) Field of Classification Search

CPC ..... H04S 7/302; H04S 3/02; H04S 2400/01; H04S 2400/11; H04S 2400/13;

(Continued)

(56) References Cited

U.S. PATENT DOCUMENTS

| | | | |
|---|---|---|---|
| 6,694,028 | B1 | 2/2004 | Matsuo |
| 7,515,719 | B2 | 4/2009 | Hooley |

(Continued)

FOREIGN PATENT DOCUMENTS

| | | |
|---|---|---|
| GB | 2255884 | 11/1992 |
| WO | 2014/159376 | 10/2014 |

OTHER PUBLICATIONS

Lopez, An architecture for Reverberation in High Order Ambisonics, 2017 (Year: 2014).*

(Continued)

*Primary Examiner* — William A Jerez Lora

(57) ABSTRACT

A method for creating an output soundfield signal from an input soundfield signal, the method including the steps of: (a) forming at least one delayed signals from the input soundfield signal, (b) for each of the delayed signals, creating an acoustically transformed delayed signal, by an acoustic transformation process, and (c) combining together the acoustically transformed delayed signals and the input soundfield signal to produce the output soundfield signal.

18 Claims, 5 Drawing Sheets

(52) U.S. Cl.
CPC ..... *H04S 2400/11* (2013.01); *H04S 2400/13* (2013.01); *H04S 2420/11* (2013.01)

(58) Field of Classification Search
CPC ..... H04S 2420/11; H04S 5/00; G10K 15/12; G10K 15/08
USPC ..... 381/1, 17, 63, 124, 303
See application file for complete search history.

(56) References Cited

U.S. PATENT DOCUMENTS

| | | | | |
|---|---|---|---|---|
| 7,577,260 | B1 | 8/2009 | Hooley | |
| 7,933,421 | B2 | 4/2011 | Asada | |
| 8,073,125 | B2 | 12/2011 | Zhang | |
| 8,103,006 | B2 | 1/2012 | McGrath | |
| 8,199,921 | B2 | 6/2012 | Katayama | |
| 8,218,774 | B2 | 7/2012 | Buchner | |
| 8,284,961 | B2 * | 10/2012 | Miyasaka | H04S 3/002 381/119 |
| 8,345,887 | B1 | 1/2013 | Betbeder | |
| 8,670,570 | B2 | 3/2014 | Zong | |
| 8,705,750 | B2 | 4/2014 | Berge | |
| 8,705,757 | B1 * | 4/2014 | Betbeder | G10H 1/0091 381/63 |
| 8,908,881 | B2 | 12/2014 | Sato | |
| 2012/0109645 | A1 | 5/2012 | Hallam | |
| 2013/0148812 | A1 | 6/2013 | Corteel | |
| 2013/0243201 | A1 | 9/2013 | Algazi | |
| 2014/0010375 | A1 | 1/2014 | Usher | |
| 2014/0185812 | A1 * | 7/2014 | Van Achte | H04S 5/005 381/18 |
| 2014/0355796 | A1 | 12/2014 | Xiang | |

OTHER PUBLICATIONS

Anderson, Adapting artificial reverberation architectures for B-Format signal processing, 2009 (Year: 2009).*

Breebaart, J. et al "High-Quality Parametric Spatial Audio Coding at Low Bit Rates" AES presented at the 116th Convention, Berlin, Germany, May 8-11, 2004, pp. 1-13.

James, B.ST. et al "Corpuscular Streaming and Parametric Modification Paradigm for Spatial Audio Teleconferencing" J. Audio Eng. Soc., vol. 56, No. 10 Nov. 2008, pp. 823-842.

Anderson, J. et al "Adapting Artificial Reverberation Architectures for B-Format Signal Processing" Ambisonics Symposium, Jun. 27, 2009, pp. 1-5.

Lopez-Lescano, F. et al "An Architecture for Reverberation in High Order Ambisonics" AES Convention, presented at the 137th Convention, Oct. 9-12, 2014, Los Angeles, USA, pp. 1-5.

Gerzon, Michael A. "Periphony: With-Height Sound Reproduction" JAES vol. 21, Issue 1, pp. 2-10, Feb. 1, 1973.

Bertet, S. et al "3D Sound Field Recording with Higher Order Ambisonics—Objective Measurements and Validation of Spherical Microphone" AES Convention, May 1, 2006, pp. 1-24.

* cited by examiner

SYSTEM AND METHOD FOR SPATIAL PROCESSING OF SOUNDFIELD SIGNALS

CROSS-REFERENCE TO RELATED APPLICATIONS

This application claims priority to U.S. Provisional Patent Application No. 62/198,440, filed Jul. 29, 2015 and European Patent Application No. 15185913.9, filed Sep. 18, 2015, each of which is hereby incorporated by reference in its entirety.

FIELD OF THE INVENTION

The present invention provides for systems and methods for the input of an audio soundfield signal and the creation of a reverberant acoustic equivalent soundfield signal.

BACKGROUND OF THE INVENTION

Any discussion of the background art throughout the specification should in no way be considered as an admission that such art is widely known or forms part of common general knowledge in the field.

Multi-channel audio signals are used to store or transport a listening experience, for an end listener, that may include the impression of a very complex acoustic scene. The multi-channel signals may carry the information that describes the acoustic scene using a number of common conventions including, but not limited to, the following:

- Discrete Speaker Channels: The audio scene may have been rendered in some way, to form speaker channels which, when played back on the appropriate arrangement of loudspeakers, create the illusion of the desired acoustic scene. Examples of Discrete Speaker Formats include stereo, 5.1 or 7.1 speaker signals, as used in many sound formats today.
- Audio Objects: The audio scene may be represented as one or more object audio channels which, when rendered by the listener's playback equipment, can recreate the acoustic scene. In some cases, each audio object will be accompanied by metadata (implicit or explicit) that is used by the renderer to pan the object to the appropriate "location" in the listener's playback environment. Examples of Audio Object Formats include Dolby Atmos (Trade Mark), which is used in the carriage of rich sound-tracks on Blu-Ray Disc and other motion picture delivery formats.
- Soundfield Channels: The audio scene may be represented by a Soundfield Format—a set of two or more audio signals that collectively contain one or more audio objects with the spatial location of each object "encoded" in the Spatial Format in the form of panning gains. Examples of Soundfield Formats include Ambisonics, and Higher Order Ambisonics (both of which are well known in the art). Example systems are described in Gerzon, M. A., Periphony: With-Height Sound Reproduction. J. Audio Eng. Soc., 1973. 21(1): p. 2-10, and 3D Sound Field Recording with Higher Order Ambisonics-Objective Measurements and Validation of Spherical Microphone S Bertet, J Daniel, S Moreau—Audio Engineering Society Convention 120, 2006

SUMMARY OF THE INVENTION

It is an object of the invention, in its preferred form to provide for the modification of multi channel audio signals that adhere to various Soundfield formats for the creation of reverberant soundfield signals.

In accordance with a first aspect of the present invention, there is provided a method for creating an output soundfield signal from an input soundfield signal, the method including the steps of: (a) forming at least one delayed signals from the input soundfield signal, (b) for each of the delayed signals, creating an acoustically transformed delayed signal, by an acoustic transformation process, and (c) combining together the acoustically transformed delayed signals and the input soundfield signal to produce the output soundfield signal Preferably, the acoustic transformation process utilises a multi-channel matrix mixer. The multi-channel matrix mixer can be formed by combining one or more spatial operations, including a spatial rotation operation. The multi-channel matrix mixer can be formed by combining one or more spatial operations, including a spatial mirror operation. The multi-channel matrix mixer can be formed by combining one or more spatial operations, including a directional gain operation. In some embodiments, the multi-channel matrix mixer can be formed by combining one or more spatial operations, including a directional permutation operation. The acoustic transformation process preferably can include frequency-dependant filtering.

In accordance with a further aspect of the present invention, there is provided a method for adding simulated reverberance to an input sound field signal, the method including the steps of: (a) receiving an input soundfield signal including at least one audio component encoded with a first direction of arrival; (b) determining a further soundfield signal including at least one simulated echo of the original audio components having alternative directions of arrival; (c) combining the input soundfield signal and the further soundfield signal to produce an output sound field signal.

In some embodiments, each simulated echo can comprise a delayed and rotated copy of the input sound field signal. In some embodiments, each simulated echo preferably can include substantially the same delay. In some embodiments, the alternative direction of arrival can comprise a geometric transformation of the first direction of arrival.

In accordance with a further aspect of the present invention, there is provided a system for processing of soundfield signals to simulate the presence of reverberance, the system including: an input unit for the input of a soundfield encoded signal; a tapped delay line for interconnected to the input unit and providing a series of tapped delays of the soundfield encoded signal; a series of acoustic transformation units interconnected to the output taps of the tapped delay line, for applying an acoustic transformation to the output taps to produce transformed delayed outputs; and a combining unit for combining the transformed delayed outputs into an output soundfield signal.

In some embodiments, the acoustic transformation units can include: a multi channel matrix multiplier for applying a geometric transformation to an output tap to produce a geometric transformed output; and a series of linear audio filters applied to each channel of the geometric transformed output.

BRIEF DESCRIPTION OF THE DRAWINGS

Embodiments of the invention will now be described, by way of example only, with reference to the accompanying drawings in which.

DETAILED DESCRIPTION

The preferred embodiments provide for a system and method which, given that an input soundfield signal contains audio components that are encoded with different directions of arrival, produces an output soundfield signal that will contain simulated echoes, such that each simulated echo will have a direction of arrival that is a function of the direction of arrival of the original audio component as it appeared in the input signal. The output soundfield signal thereby provides for reverberance and other simulated audio effects.

Soundfield Formats

An N-channel Soundfield Format is often defined by it's panning function, $P_N(\phi)$. Specifically, $G=P_N(\phi)$, where G is an [N×1] column vector of gain values, and $\phi$ defines the spatial location of the object. i.e:

$$G_N = \begin{pmatrix} g_1 \\ g_2 \\ \vdots \\ g_N \end{pmatrix} = P_N(\phi) \tag{1}$$

Hence, a set of M objects (represented by the M audio signals $o_1(t)$, $o_2(t)$, . . . , $o_M(t)$) can be encoded into a N-channel Spatial Format signal $X_N(t)$ as per Equation 2 below (where object m is "located" at the position defined by $\phi_m$):

$$X_N(t) = \sum_{m=1}^{M} P(\phi_m) \times o_m(t) \tag{2}$$

$$X_N(t) = \begin{pmatrix} x_1(t) \\ x_2(t) \\ \vdots \\ x_N(t) \end{pmatrix} \tag{3}$$

The signal $X_N(t)$ can be referred to as an Anechoic Mixture of the audio objects. The symbol $\phi_m$ is used to denote the abstract concept of "the location of object m". In some cases, this symbol may be used to indicate the 3-vector: $\phi_m=(x_m, y_m, z_m)$, indicating that the object is located at a specific point in 3D space. In other cases, a restriction can be added that $\phi_m$ corresponds to a unit-vector, so that $x_m^2+y_m^2+z_m^2=1$.

Acoustic Modelling With Soundfield Signals

When an audio object and a listener are both located within the boundaries of an acoustic space (defined by a set of acoustically reflective surfaces), any sound emitted by the audio object will reach the listener via multiple paths. This phenomenon is well known in the art, and the resulting sound, received at the listening position, is said to be reverberant. The number of acoustic paths, formed by the propagation of sound from the object and reflected off acoustic surfaces to reach the listener, may be infinite, but a reasonably close estimate of the sound received at the listening position may be formed by considering a finite number (E) of echoes.

Figure 1:
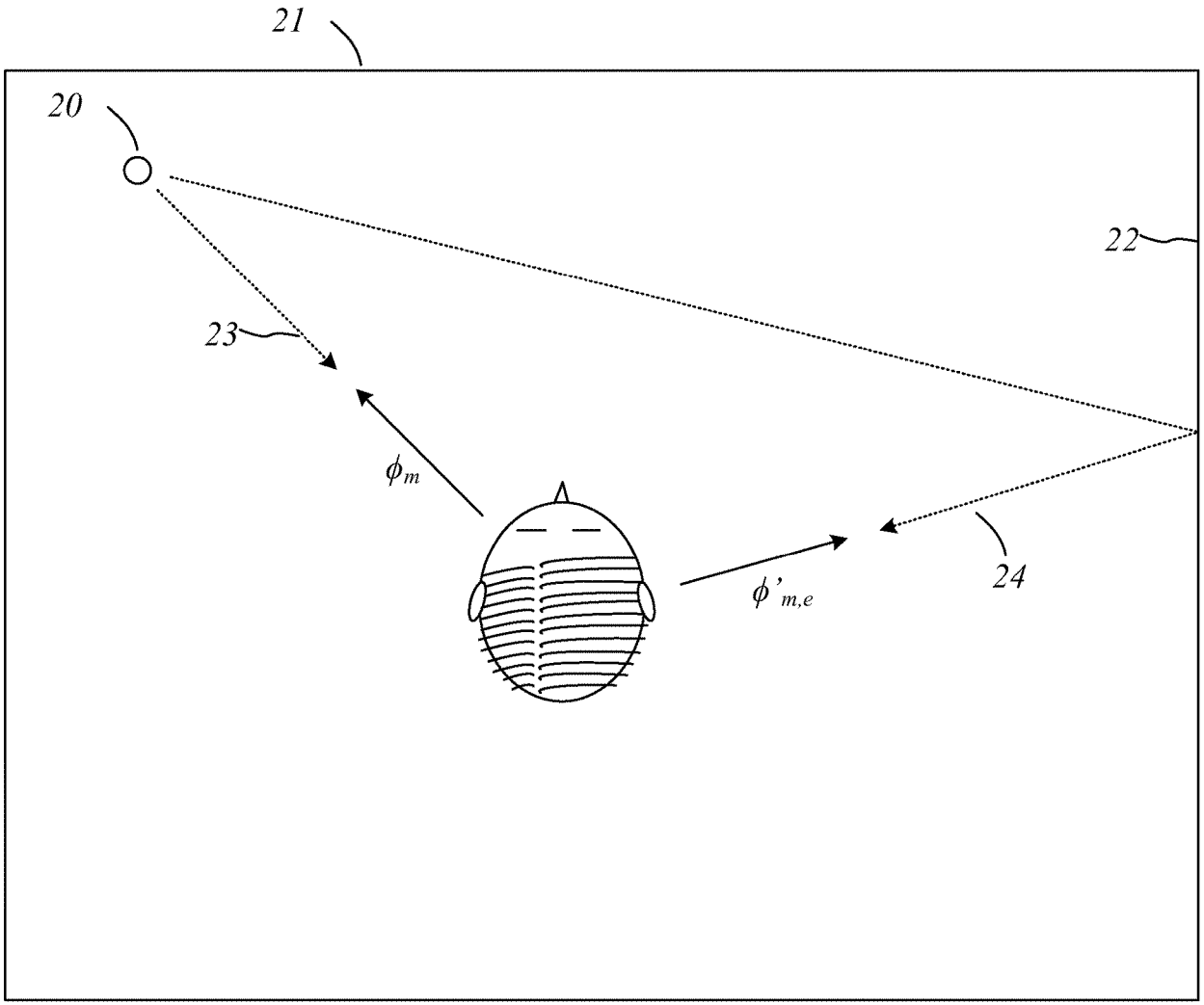
FIG. 1 illustrates schematically an audio object, at direction $\phi_m$, and an echo at direction $\phi'_{m,e}$.
Figure 2:
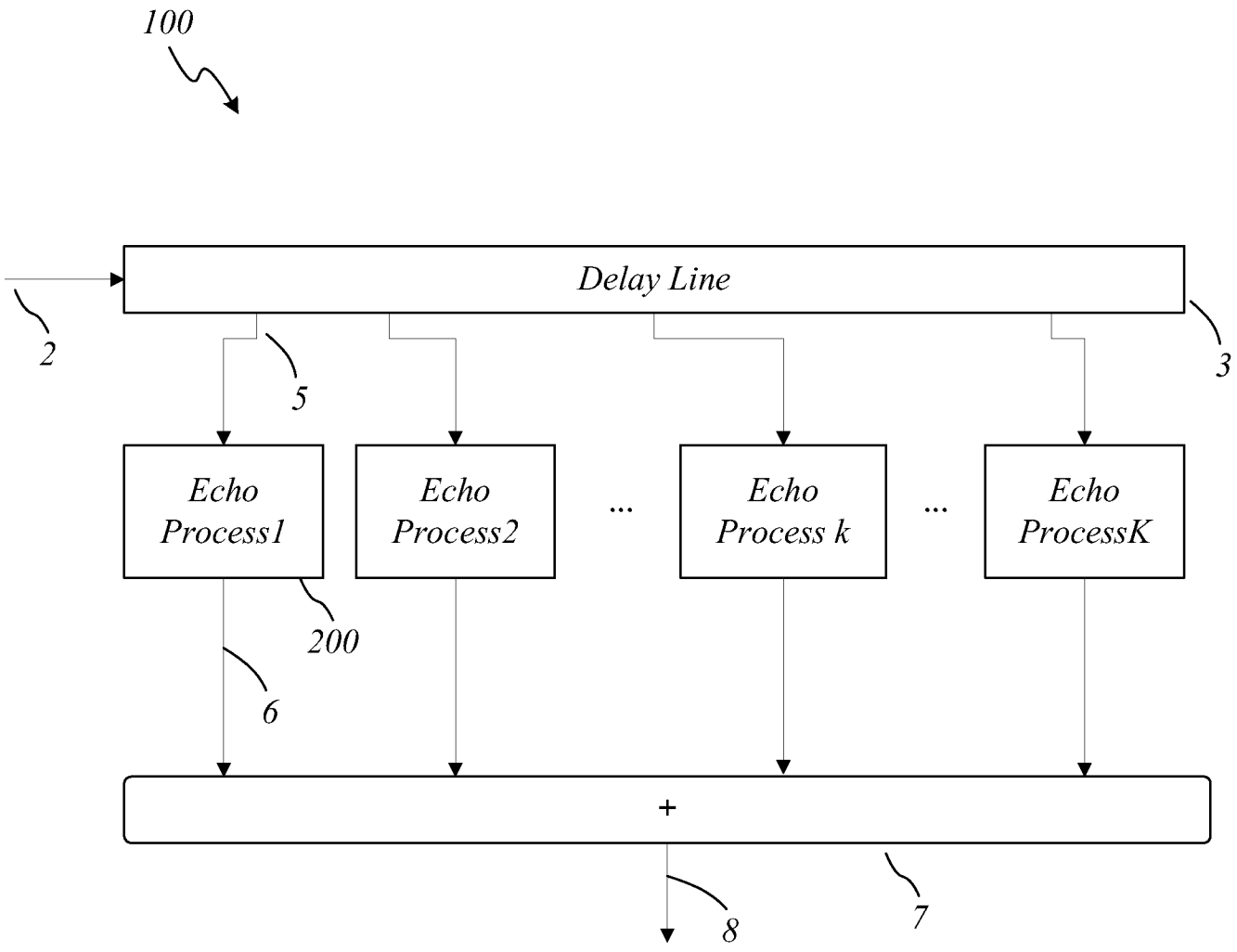
FIG. 2 is a schematic block diagram of a tapped delay line.

FIG. 2 illustrates an example of reverberance, where the sound from audio object m, 20, is received at the listening position from direction $\phi_m$, along with one echo (echo e) being received at the listening position from direction $\phi'_{m,e}$.

In order to express this mathematically, the following variables can be defined:

$e$: echonumber $1 \le e \le E$ (4)

$\phi_m$: the direction of arrival of sound from object $m$ (5)

$\phi'_{m,e}$: the direction of arrival of echo $e$ from the object $m$ (6)

$d_{m,e}$: the delay (in samples) of echo $e$ from object $m$ (7)

$h_{m,e}(t)$: the impulse response of echo $e$ from object $m$ (8)

Equation 2 shows how an N-channel soundfield signal, $X_N(t)$, may be created by combining M audio objects, based on the assumption that each audio object has a location ($\phi_m$) and an audio signal ($o_m(t)$).

It is possible to devise a more complex acoustic soundfield signal, $R_N(t)=X_N(t)+Y_N(t)$, intended to contain all of the M audio objects, combined together in a way that includes a simulation of an acoustic space (by including E echoes for each object). This is shown in Equation 10 below:

$$R_N(t) = X_N(t) + Y_N(t) \tag{9}$$

$$R_N(t) = \sum_{m=1}^{M} P(\phi_m) \times o_m(t) + \sum_{m=1}^{M} \sum_{e=1}^{E} P(\phi'_{m,e}) \times [o_m \otimes h_{m,e}]\left(t - \frac{d_{m,e}}{F_s}\right) \tag{10}$$

and hence:

$$Y_N(t) = \sum_{m=1}^{M} \sum_{e=1}^{E} P(\phi'_{m,e}) \times [o_m \otimes h_{m,e}]\left(t - \frac{d_{m,e}}{F_s}\right) \tag{11}$$

The signal $Y_N(t)$ can be referred to as the Reverberant Mixture of the audio objects. The complete acoustic-simulation is created by summing together the Anechoic Mixture, $X_N(t)$, and the Reverberant Mixture, $Y_N(t)$.

In Equation 10, the terminology $[o_m \otimes h_{m,e}](t)$ is used to indicate the convolution of the object audio signal $o_m(t)$ with the impulse response $h_{m,e}(t)$, and hence $$[o_n \otimes h_{m,e}]\left(t - \frac{d_{m,e}}{F_s}\right)$$

indicates the convolved signal with an additional delay of $d_{m,e}$ samples (where $F_s$ is the sample frequency).

Those familiar with the art will also recognise that Equation 11 may be written in terms of the frequency domain equation in Equation 12 below:

$$\hat{Y}_N(z) = \sum_{m=1}^{M} \sum_{e=1}^{E} P(\phi'_{m,e}) \times \hat{o}_m(z) H_{m,e}(z) z^{-d_{m,e}} \tag{12}$$

where $\hat{Y}_N(z)$, $\hat{o}_m(z)$ and $H_{m,e}(z)$ are the z—domain equivalents of $Y_N(t)$, $o_m(t)$ and $h_{m,e}(t)$ respectively.

Geometric Transformations of Soundfield Signals

The N-channel soundfield signal format is defined by the panning function, P(ϕ). One popular choice for this panning function is the 4-channel (N=4) Ambisonic panning function (assuming ϕ is expressed in the form of a 3×1 unit-vector: $\phi=[x\ y\ z]^T$):

$$P_{WXYZ}(\phi) = P_{WXYZ}([x\ \ y\ \ z]^T) = \begin{pmatrix} 1 \\ \sqrt{2}\,x \\ \sqrt{2}\,y \\ \sqrt{2}\,z \end{pmatrix} \tag{13}$$

Now, given a 3×3 matrix, A, from examination of Equation 13, it can be seen that:

$$P_{WXYZ}(A\times\phi) = \begin{pmatrix} 1 & 0 & 0 & 0 \\ 0 & & & \\ 0 & & A & \\ 0 & & & \end{pmatrix} \times P_{WXYZ}(\phi) \tag{14}$$

Equation 14 tells us that, if we wish to apply a 3×3 matrix transformation, A, to the (x, y, z) coordinates of an object location, prior to the computation of the panning function, we can instead achieve this transformation as a 4×4 matrix operation, applied to the panning-gain vector, after the computation of the panning function.

The result shown in in Equation 14 can be applied to Equation 2, in order to manipulate the location of all objects in audio scene, as per Equation 17 below. In this case, a transformed soundfield signal, $X'_N(t)$ is created from $X_N(t)$, achieving the same result that would have occurred if all of the objects had their (x, y, z) locations modified by the 3×3 matrix A.

$$X'_N(t) = \sum_{m=1}^{M} P(A\times\phi_m)\times o_m(t) \tag{15}$$

$$= \begin{pmatrix} 1 & 0 & 0 & 0 \\ 0 & & & \\ 0 & & A & \\ 0 & & & \end{pmatrix} \times \sum_{m=1}^{M} P(\phi_m)\times o_m(t) \tag{16}$$

$$= \begin{pmatrix} 1 & 0 & 0 & 0 \\ 0 & & & \\ 0 & & A & \\ 0 & & & \end{pmatrix} \times X_N(t) \tag{17}$$

It is known in the art, that certain manipulations of the objects within an N-channel soundfield can be achieved by applying a N×N matrix to the N channels of the soundfield signal. In the example given here, whereby the soundfield panning-function is the known Ambisonic panning function, the available manipulations of the soundfield include:

Rotation: The locations of all objects within a soundfield can be rotated around the listening position. The manipulation of the (x, y, z) coordinates of each object may be defined in terms of a 3×3 matrix, A, and the manipulation of the 4-channel soundfield signal may be carried out according to Equation 17.

Mirroring: The locations of all objects within a soundfield may be mirrored about a plane that passes through the listening position. The manipulation of the (x, y, z) coordinates of each object may be defined in terms of a 3×3 matrix, A, and the manipulation of the 4-channel soundfield signal may be carried out according to Equation 17.

Dominance: A transformation of the 4-channel soundfield signal (known as the Lorentz transformation) may be applied by multiplying the 4 channels of the signal by the following 4×4 matrix:

$$Dominance_X(\lambda) = \begin{pmatrix} \frac{1}{2}(\lambda+\lambda^{-1}) & \frac{1}{2\sqrt{2}}(\lambda-\lambda^{-1}) & 0 & 0 \\ \frac{1}{\sqrt{2}}(\lambda-\lambda^{-1}) & \frac{1}{2}(\lambda+\lambda^{-1}) & 0 & 0 \\ 0 & 0 & 1 & 0 \\ 0 & 0 & 0 & 1 \end{pmatrix}$$

The result of this transformation is to boost the gain of the audio objects located at ϕ=(1, 0, 0) by λ. Audio objects located at ϕ=(−1, 0, 0) will be attenuated by $\lambda^{-1}$.

All Rotation and Mirroring operations are defined in terms of 3×3 unitary matrices (so that $A\times A^T=I_{3\times3}$). If det(A)=1, the matrix A corresponds to a rotation in 3D space, and if det(A)=−1, the matrix A corresponds to a mirroring operation in 3D space. In many of the embodiments described below, it will be convenient to assume that A is unitary.

The above manipulations of Ambisonic soundfield signal are known in the Art.

Creation of a Reverberant Mixture

It is one intention of the preferred embodiments to create a Reverberant Mixture, $Y_N(t)$, of the audio objects from the Anechoic Mixture, $X_N(t)$. In the preferred embodiments, a unique Shared Echo Model is utilised, whereby all objects share the same time-delay pattern of echoes.

In order to use the Anechoic Mixture, $X_N(t)$, as the starting point for creating the Reverberant Mixture, $Y_N(t)$, it is desirable to apply some modified rules for the behaviour of the reverberation function as shown in Equation 10. In one embodiment of the invention, the following simplifications may be made:

Echo Time Simplification: It will be recalled that the original reverberation calculation (as per Equation 10) treats the reverberation for each object as a series of echoes, wherein for object m, echo e, has a time delay (relative to the direct-path) equal to $d_{m,e}$ (so, the echo times are different for each object). For the new Shared Echo Model, a delay $d'_k$ is defined to be the arrival time (relative to the direct sound) of echo k, and this delay is the same for every object (and hence, the echo delay, $d'_k$, is no longer dependant on the object identifier, m).

Echo Direction Simplification: The original reverberation calculation (as per Equation 10) treats the reverberation for each object as a series of echoes, wherein for object m, echo e has a direction of arrival, $\phi'_{m,e}$ (so, the echo arrival directions are different for each object). For the new, simplified method, an angle is defined as: $\phi'_{m,k}=A_k\times\phi_m$ to be the direction of arrival of echo k, so that this direction is now formed by a simple geometric transformation of the objects location, $\phi_m$.

The two simplifications provide for a simplified processing chain. FIG. 2 shows one method that may be used to achieve this, with the corresponding z—domain transfer function being shown in Equation 18 below:

$$\hat{Y}_N(z) = \sum_{k=1}^{K} z^{-d'_k} EchoProcess_k \times X_N(z) \tag{18}$$

In FIG. 2, the processing chain 100 includes a Delay Line, 3, with K taps (and, in the following explanation, the variable k can be used to refer to a specific tap number, so that $k \in \{1, 2, \ldots, K\}$). The input, 2, to the Delay Line 3 is the N-channel input signal, $X_N(t)$. At each of the taps (for example, k=1), an N-channel delayed signal, e.g. 5, is taken from the Delay Line, and processed via an acoustic transformation process, 200, to produce an acoustically transformed delayed signal, 6. The set of K acoustically transformed delayed signals are added together 7 to produce the output soundfield signal, 8.

The time delay, from the input soundfield signal, 2, to the delayed signal, for tap k, will be defined to be $d'_k$ sample periods. So, for example, in FIG. 2, the delay from the input soundfield signal, 2, to the delayed signal 5, corresponding to the first tap (k=1), will be $d'_1$ sample periods.

Figure 3:
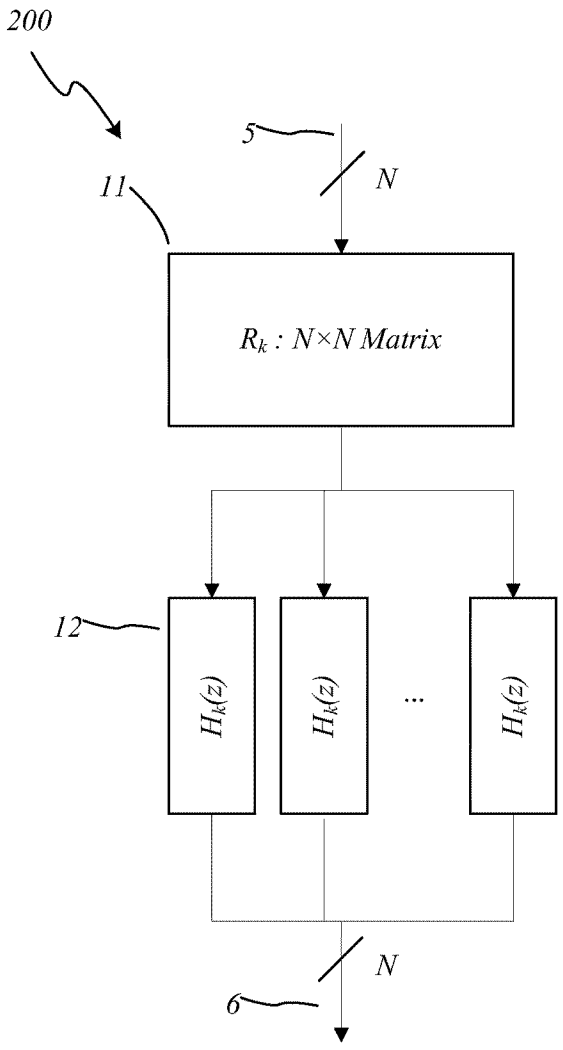
FIG. 3 is a schematic block diagram of an echo processor.

FIG. 3 illustrates one example form of implementation of an Echo Processor 200 which applies an acoustic transformation process. In FIG. 3, the input N-channel delayed signal 5, is processed, to produce the N-channel acoustically transformed delayed signal 6. In the example shown in FIG. 3, two operations are performed by the acoustic transformation process, a multi-channel matrix mixer (represented by the N×N matrix $R_k$) 11, and a linear time-invariant filter, $H_k(z)$ e.g. 12, applied to each of the N channels of the soundfield signal.

The intention of the acoustic transformation process, in one embodiment, is to create a simulation of the $k^{th}$ acoustic echo according to the following operating principles:

Echo Delay: The time delay of echo k is defined by use of the Delay Line so that input to the Delay Line 2 (of FIG. 2), is delayed by $d'_k$ samples to give the input 5, to the $k^{th}$ acoustic transformation process (referring to FIG. 2).

Echo Direction: The direction of arrival of echo k, for object m, is determined by applying a matrix, $A_k$ to the direction unit-vector of the object, $\phi_m=[x_m\ y_m\ z_m]^T$, resulting in:

$$\phi'_{m,k} = A_k \times \begin{pmatrix} x_m \\ y_m \\ z_m \end{pmatrix}$$

and we therefore create the echo signal, with the corresponding direction-of-arrival, according to Equation 17 (substitution $A_k$ in place of A in Equation 17). This means that, in the case where our soundfield is represented in the Ambisonic format, the following matrix, $R_k$ is computed according to:

$$R_k = \begin{pmatrix} 1 & 0 & 0 & 0 \\ 0 & & & \\ 0 & & A_k & \\ 0 & & & \end{pmatrix}$$

Echo Amplitude and Frequency Response: The amplitude and frequency response of echo k are provided by the filter, $H_k(z)$ e.g. 12, applied to each of the N channels as per FIG. 3.

Further Generalisations and Alternative Embodiments:

In the case where the soundfield is defined in terms of an Ambisonic panning function (as per Equation 13), a more general version of the acoustic transformation process may be built by converting the Ambisonic signals from B-Format to A-Format. This transformation is known in the art.

The following conversion matrices can be defined:

$$AtoB = \begin{bmatrix} 1 & 1 & 1 & 1 \\ \sqrt{\frac{2}{3}} & -\sqrt{\frac{2}{3}} & -\sqrt{\frac{2}{3}} & \sqrt{\frac{2}{3}} \\ \sqrt{\frac{2}{3}} & -\sqrt{\frac{2}{3}} & \sqrt{\frac{2}{3}} & -\sqrt{\frac{2}{3}} \\ \sqrt{\frac{2}{3}} & \sqrt{\frac{2}{3}} & -\sqrt{\frac{2}{3}} & -\sqrt{\frac{2}{3}} \end{bmatrix} \tag{19}$$

$$BtoA = \begin{bmatrix} \frac{1}{4} & \sqrt{\frac{3}{32}} & \sqrt{\frac{3}{32}} & \sqrt{\frac{3}{32}} \\ \frac{1}{4} & -\sqrt{\frac{3}{32}} & -\sqrt{\frac{3}{32}} & \sqrt{\frac{3}{32}} \\ \frac{1}{4} & -\sqrt{\frac{3}{32}} & \sqrt{\frac{3}{32}} & -\sqrt{\frac{3}{32}} \\ \frac{1}{4} & \sqrt{\frac{3}{32}} & -\sqrt{\frac{3}{32}} & -\sqrt{\frac{3}{32}} \end{bmatrix} \tag{20}$$

Equation 19 defines a 4×4 matrix, AtoB that maps an A-format signal, represented by a 4×1 column vector, to a B-format signals, also represented by a 4×1 column vector: BF=AtoB×AF. Likewise, Equation 20 defines the 4×4 matrix, BtoA that is the inverse of AtoB.

Using these transformation matrices, an acoustic transformation process can be implemented by:

$$\text{EchoProcess}_k = Rot''_k \times AtoB \times H'_k \times BtoA \times Rot'_k \tag{21}$$

where:

$$Rot'_k = \begin{pmatrix} 1 & 0 & 0 & 0 \\ 0 & & & \\ 0 & & R' & \\ 0 & & & \end{pmatrix} \tag{22}$$

$$Rot''_k = \begin{pmatrix} 1 & 0 & 0 & 0 \\ 0 & & & \\ 0 & & R'' & \\ 0 & & & \end{pmatrix} \tag{23}$$

$$H'_k = \begin{pmatrix} H_{k,1}(z) & 0 & 0 & 0 \\ 0 & H_{k,2}(z) & 0 & 0 \\ 0 & 0 & H_{k,3}(z) & 0 \\ 0 & 0 & 0 & H_{k,4}(z) \end{pmatrix} \tag{24}$$

where R' and R" are arbitrary 3×3 rotation matrices.

Two new intermediate matrices can be defined: $B_k$=BtoA×$Rot'_k$, and $C_k$=$Rot''_k$×AtoB, and this allows us to simplify Equation 21 to get Equation 25:

$$\text{EchoProcess}_k = C_k \times H'_k \times B_k \tag{25}$$

Figure 4:
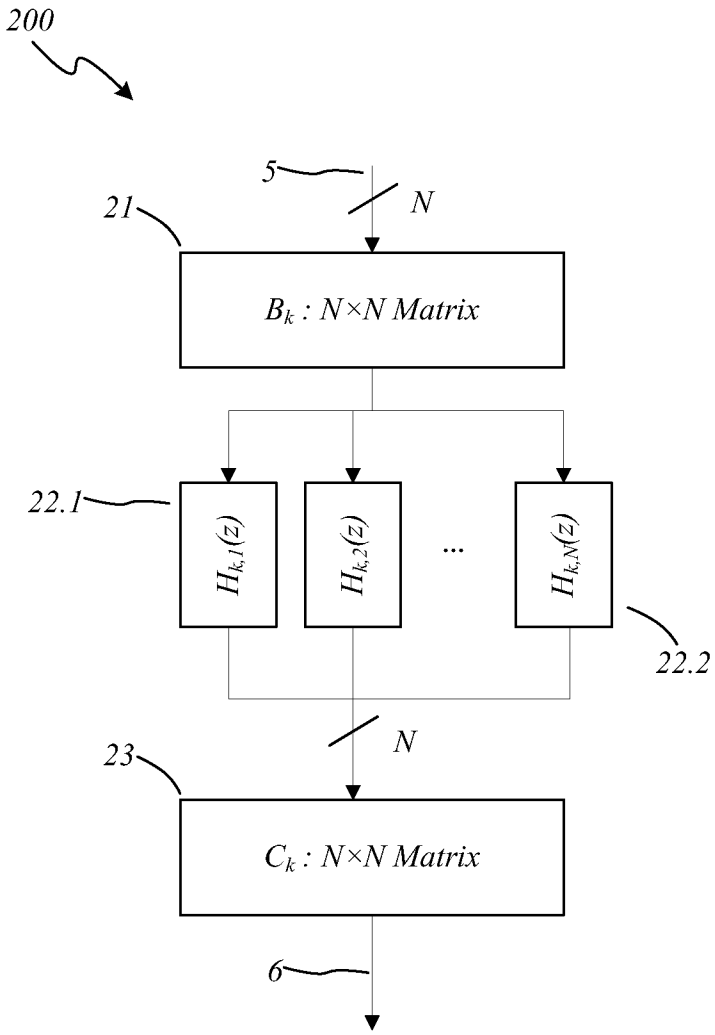
FIG. 4 is a schematic block diagram of an echo processor with direction-dependant filtering.

A processing train for implementing the method of Equation 25 is also shown in FIG. 4, with the matrix processing Bk and Ck being separately implemented 21, 23.

Figure 5:
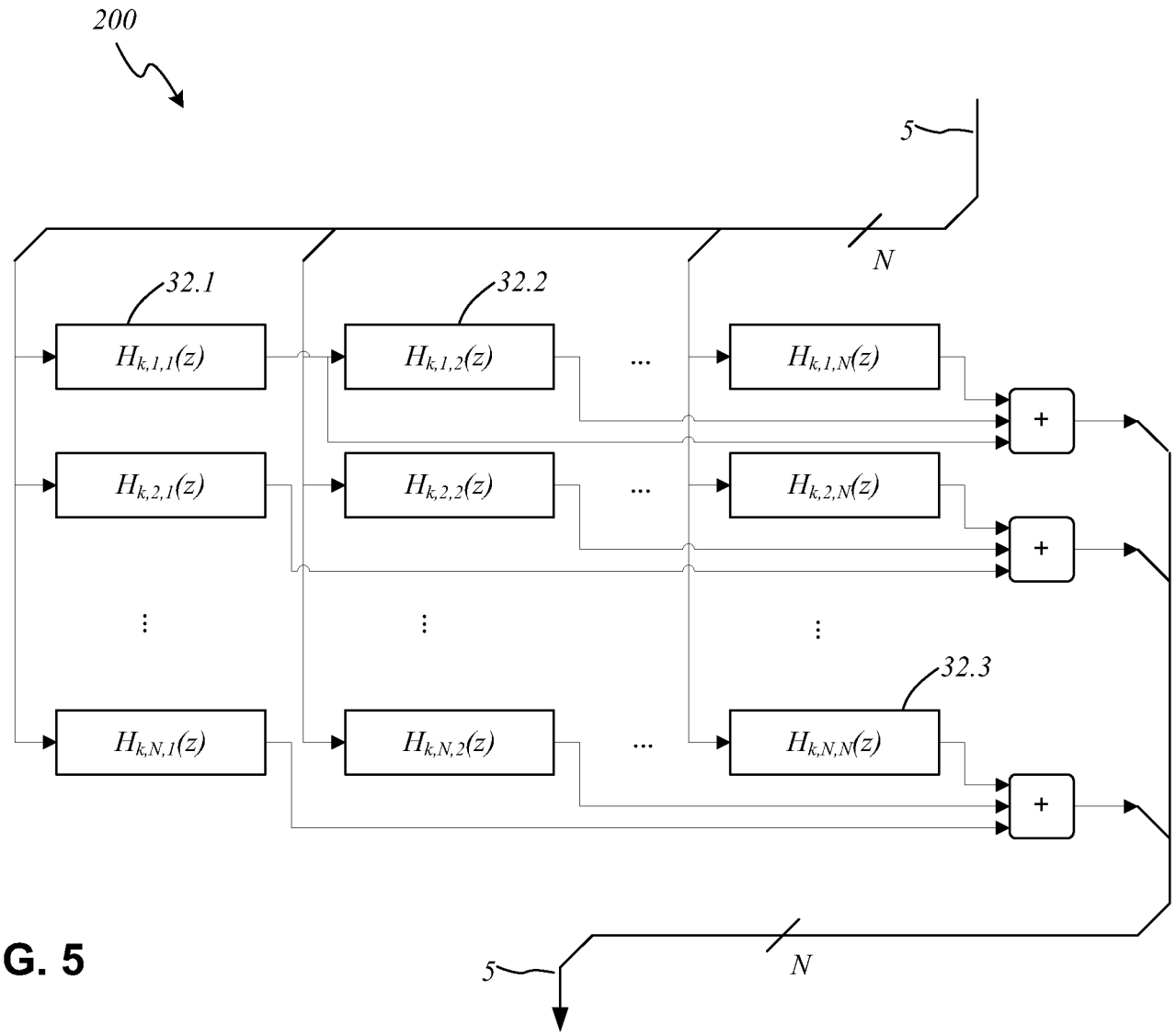
FIG. 5 illustrates an alternative form of an echo processor.

As shown in FIG. 5, in it's most general form, an acoustic transformation process can be implemented as a 4×4 matrix of arbitrary filter operations 200.

Methods for Creation of More Complex Room Impulse Responses

The methods described above may also be combined with alternative reverberation processes, which may be known in the art, to produce a reverberant mixture that contains some echoes generated according to the above described methods, along with additional echoes and reverberation that are generated by the alternative methods.

Interpretation

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

As used herein, the term "exemplary" is used in the sense of providing examples, as opposed to indicating quality. That is, an "exemplary embodiment" is an embodiment provided as an example, as opposed to necessarily being an embodiment of exemplary quality.

It should be appreciated that in the above description of exemplary embodiments of the invention, various features of the invention are sometimes grouped together in a single embodiment, FIG., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

What is claimed is:

1. A method for creating an output soundfield signal from an input soundfield signal, the method including the steps of:

(a) forming at least one delayed signal from said input soundfield signal, (b) for each of said delayed signals, creating an acoustically transformed delayed signal, by an acoustic transformation process, and (c) combining together said acoustically transformed delayed signals and said input soundfield signal to produce said output soundfield signal, wherein the acoustic transformation process utilises a multi-channel matrix mixer.

2. A method according to claim 1, wherein the acoustic transformation process includes creating a direction of arrival of the respective delayed signal different from a direction of arrival of the input sound field, relative to a listening position.

3. A method according to claim 2, wherein the direction of arrival of the respective delayed signal is created by applying a geometric transformation to the direction of arrival regarding the input sound field.

4. A method as claimed in claim 1, wherein the multi-channel matrix mixer is formed by combining one or more spatial operations, including a spatial rotation operation.

5. A method as claimed in claim 1, wherein the acoustic transformation process includes frequency-dependant filtering.

6. A method for adding simulated reverberance to an input sound field signal, the method including the steps of:

(a) receiving an input soundfield signal including at least one audio component encoded with a first direction of arrival;

(b) determining a further soundfield signal including at least one simulated echo of the original audio components, the at least one simulated echo having an alternative direction of arrival;

(c) combining the input soundfield signal and the further soundfield signal to produce an output sound field signal, wherein determining the further soundfield utilizes a multi-channel matrix mixer.

7. A method as claimed in claim 6 wherein each simulated echo comprises a delayed and rotated copy of the input sound field signal.

8. A method as claimed in claim 7 wherein each simulated echo includes substantially the same delay.

9. A method as claimed in claim 6, wherein the alternative direction of arrival comprises a geometric transformation of the first direction of arrival.

10. A method according to claim 6, wherein the direction of arrival and the alternative direction of arrival relate to a listening position.

11. A system for processing of soundfield signals to simulate the presence of reverberance, the system including:

an input unit for the input of a soundfield encoded signal;

a tapped delay line interconnected to the input unit and providing a series of tapped delays of the soundfield encoded signal;

a series of acoustic transformation units interconnected to the output taps of the tapped delay line, for applying an acoustic transformation to the output taps to produce transformed delayed outputs; and a combining unit for combining the transformed delayed outputs into an output soundfield signal, wherein said series of acoustic transformation units includes:

a multi channel matrix multiplier for applying a geometric transformation to an output tap to produce a geometric transformed output; and a series of linear audio filters applied to each channel of the geometric transformed output.

12. A system as claimed in claim 11, wherein said series of linear audio filters are linear time invariant filters.

13. A system as claimed in claim 11, wherein said multi channel matrix multiplier implements one or more spatial operations on an output tap.

14. A system as claimed in claim 11, wherein the acoustic transformation includes creating a direction of arrival of the respective output tap different from a direction of arrival of the soundfield encoded signal, relative to a listening position.

15. A system according to claim 14, wherein the direction of arrival of the respective output tap is created by applying a geometric transformation to the direction of arrival regarding the soundfield encoded signal.

16. A system as claimed in claim 13 wherein said spatial operations include at least a spatial rotation operation.

17. A computer readable non-transitory storage medium including program instructions for the operation of a computer in accordance with the method according to claim 1.

18. A method as claimed in claim 6, wherein the multi-channel matrix mixer is formed by combining one or more spatial operations, including a spatial rotation operation.

* * * * *